US011426771B2

(12) United States Patent
Kawamori et al.

(10) Patent No.: US 11,426,771 B2
(45) Date of Patent: Aug. 30, 2022

(54) CLEANING MACHINE AND CLEANING METHOD

(71) Applicant: SUGINO MACHINE LIMITED, Uozu (JP)

(72) Inventors: Yoshiteru Kawamori, Uozu (JP); Toyoaki Mitsue, Uozu (JP); Takuya Kanemoto, Uozu (JP)

(73) Assignee: SUGINO MACHINE LIMIIED, Uozu (JP)

( * ) Notice: Subject to any disclaimer, the term of this patent is extended or adjusted under 35 U.S.C. 154(b) by 0 days.

(21) Appl. No.: 17/018,171

(22) Filed: Sep. 11, 2020

(65) Prior Publication Data

US 2021/0078050 A1 Mar. 18, 2021

(30) Foreign Application Priority Data

Sep. 12, 2019 (JP) ..... JP2019-166072

(51) Int. Cl.
*B08B 3/02* (2006.01)
*B08B 3/10* (2006.01)
*B08B 13/00* (2006.01)

(52) U.S. Cl.
CPC ..... *B08B 3/102* (2013.01); *B08B 3/02* (2013.01); *B08B 13/00* (2013.01)

(58) Field of Classification Search
CPC ..... B08B 3/02; B08B 3/102; B08B 13/00
See application file for complete search history.

(56) References Cited

U.S. PATENT DOCUMENTS 5,368,649 A * 11/1994 Tsukazaki ..... B08B 3/12 134/1
6,125,861 A 10/2000 Gupta et al.
6,253,462 B1 7/2001 Schwarz
(Continued)

FOREIGN PATENT DOCUMENTS

CN 1246082 A 3/2000
CN 107433557 A 12/2017
(Continued)

OTHER PUBLICATIONS

JP2014151280—Machine Translation (Year: 2014).*
(Continued)

*Primary Examiner* — Marc Lorenzi
(74) *Attorney, Agent, or Firm* — Tim Tingkang Xia, Esq.; Locke Lord LLP

(57) ABSTRACT

The present disclosure provides a cleaning machine, including: a cleaning chamber; a turn table having a plurality of areas arranged around a rotary axis, configured to turn one area of the plurality of areas to the cleaning station and another area to the transport station, each of the plurality of areas having: a cleaning tank including a closable opening, a rotating device arranged at the cleaning tank, and a cleaning table on which the object is placed, and which is arranged on the rotating device and rotatably arranged in the cleaning tank; a nozzle moving device arranged in the cleaning station; a cleaning nozzle arranged on the nozzle moving device; a shutter arranged in the cleaning station and closing the closable opening; and a shutter moving device configured to move the shutter toward the closable opening.

10 Claims, 4 Drawing Sheets

(56) References Cited

U.S. PATENT DOCUMENTS

| | | | | |
|---|---|---|---|---|
| 6,321,760 | B1 | 11/2001 | Meissner | |
| 8,961,697 | B2 * | 2/2015 | Sugio | B08B 3/024 134/22.18 |
| 2009/0199358 | A1 * | 8/2009 | Koizumi | B08B 5/02 15/320 |
| 2012/0080060 | A1 * | 4/2012 | Haremaki | B08B 1/00 134/70 |
| 2017/0343084 | A1 * | 11/2017 | Haremaki | F16H 57/027 |

FOREIGN PATENT DOCUMENTS

| | | | | |
|---|---|---|---|---|
| JP | 2001327932 | A | | 11/2001 |
| JP | 2002086080 | A | * | 3/2002 |
| JP | 2014151280 | A | | 8/2004 |
| JP | 6008753 | B2 | | 10/2016 |
| JP | 2017110866 | A | * | 6/2017 |
| JP | 2017209627 | A | | 11/2017 |

OTHER PUBLICATIONS

JP2017110866—Machine Translation (Year: 2017).*
JP2002086080—Machine Translation (Year: 2002).*
EPO, "The Extended European Search Report for EP Application No. 20195809.7", The Hague, dated Mar. 11, 2021.
JPO, "Japanese Office Action for JP Application No. 2019-166072", Japan, dated Sep. 29, 2020.
JPO, "Decision to Grant a Patent for JP Application No. 2019-166072", Japan, dated Nov. 26, 2020.
Chinese Patent Office, "Chinese Office Action dated May 21, 2021 for Chinese Application No. 202010824160.3", China, dated May 21, 2021.
China Patent Office, the office action of the related Chinese application No. 202010824160.3 dated Sep. 7, 2021.

* cited by examiner

CLEANING MACHINE AND CLEANING METHOD

CROSS REFERENCE TO RELATED APPLICATION

This application claims priority to and the benefit of Japanese Patent Application No. 2019-166072, entitled "Cleaning Machine and Cleaning Method", filed on Sep. 12, 2019, which is incorporated herein by reference in its entirety.

FIELD OF THE INVENTION

The present disclosure relates to a cleaning machine and a cleaning method.

BACKGROUND OF THE INVENTION

A conventional cleaning machine includes a turret with a nozzle, a turn table arranged with a plurality of fixed parts for fixing a workpiece, and a cleaning chamber with a loading/unloading space and a cleaning space. The fixed parts arranged in the loading/unloading space are moved to the cleaning space, and the fixed parts arranged in the cleaning space are moved to the loading/unloading space by turning the turn table. The conventional cleaning machines do not immerse an object in a cleaning liquid to perform jet flow cleaning.

SUMMARY OF THE INVENTION

The present disclosure provides a cleaning machine having a turn table and immersing an object in a cleaning liquid to perform jet cleaning.

A first aspect of the present disclosure proposes a cleaning machine for cleaning an object, which includes: a cleaning chamber having a cleaning station and a transport station; a turn table having a plurality of areas arranged around a rotary axis, and configured to turn one area of the plurality of areas to the cleaning station and another area to the transport station, each of the plurality of areas having: a cleaning tank including a closable opening, a rotating device arranged at the cleaning tank, and a cleaning table on which the object is placed, and which is arranged on the rotating device and rotatably arranged in the cleaning tank; a nozzle moving device arranged in the cleaning station; a cleaning nozzle arranged on the nozzle moving device; a shutter arranged in the cleaning station and closing the closable opening; and a shutter moving device configured to move the shutter toward the closable opening.

A second aspect of the present disclosure further proposes a cleaning method for an object, including: loading the object into a cleaning table arranged in a cleaning tank of a transport station; turning a turn table to transport the object, the cleaning tank and the cleaning table to a cleaning station; closing a closable opening of the cleaning tank arranged in the cleaning station by a shutter; filling the cleaning tank with cleaning liquid so as to immerse the object in the cleaning liquid; immerging a nozzle in the cleaning tank, and cleaning the object by the jet flow of the cleaning liquid generated from the nozzle; moving the shutter away from the opening, and discharging the cleaning liquid in the cleaning tank; and turning the turn table to transport the object, the cleaning tank and the cleaning table to the transport station.

The cleaning includes removing burrs by high-pressure jet flow.

The plurality of areas is, for example, 2-4 areas. The number of the stations included in the cleaning machine is the same as that of the plurality of areas. The cleaning station is an submerged cleaning station in which the object is immersed in the cleaning liquid and cleaned by jet flow of cleaning liquid. When there are three or more areas and three or more stations, for example, the cleaning machine further includes an open-air cleaning station in which the object and the cleaning nozzle may be exposed to the atmosphere, and the jet flow of cleaning liquid generated by the nozzle may collide with the object.

The cleaning tank is an open tank with a top opening. Preferably, the closable opening is located on the back surface when viewing the areas from the rotary axis. The closable opening may also reach the top end of the cleaning tank. The closable opening may be closed by the shutter, so that the cleaning liquid can be stored in the cleaning tank. When the shutter opens the closable opening, the cleaning liquid is discharged from the cleaning tank. The shutter constitutes a part of the cleaning tank and is also a drain valve.

The turret may include multiple nozzles. For example, the submerged spray nozzle extends in the vertical direction and has a spout at its bottom end.

The cleaning machine includes a cleaning liquid supply device. The cleaning liquid supply device is, for example, a pump or a supply tank. The supply tank is arranged above the cleaning tank. The supply tank is arranged above the top of the cleaning chamber, for example. The supply tank includes a supply valve. When the supply valve is opened, the cleaning liquid is supplied from the supply tank to the cleaning tank.

The cleaning tank is closed by the shutter, and when the cleaning liquid is filled, the object is immersed in the cleaning liquid. The nozzle is moved by the nozzle moving device. The submerged spray nozzle is inserted into the cleaning liquid stored in the cleaning tank from the top part of the cleaning tank, and sprays the cleaning liquid toward the object. The object is cleaned by the jet flow of cleaning liquid.

The shutter moving device is, for example, a driving cylinder. Preferably, the shutter moving device includes a guide. The shutter is supported by the guide, and moves between a closed position where the shutter closes the closable opening and a retracted position where the shutter is away from the closable opening and the turn table can turn. In the closed position, the shutter is pressed against the closable opening by the shutter moving device.

The seal is, for example, a rubber seal. When the shutter is in the closed position, the shutter pushes against the seal, and the seal fills in the gap between the periphery of the closable opening and the shutter. In addition, the seal seals between the cleaning tank and the shutter. In addition, the shutter or seal does not need to completely close the closable opening. The cleaning liquid may also be supplied from a nozzle or a cleaning liquid supply device.

The closable opening may be arranged on the bottom surface of the cleaning tank. In this case, the shutter can be raised or lowered.

Preferably, the rotating device can freely rotate the cleaning table and the object regardless of the position of the shutter.

It is also possible to configure a drying device at the transport station. The drying device is, for example, a blowing device or a decompression drying device. A moving device that moves the object relative to the drying device may be arranged at the transport station. The moving device is, for example, a nozzle moving device that brings a blowing nozzle close to the object on the cleaning table.

When the blowing device brings the blowing nozzle close to the object, it is also possible to rotate the cleaning table by the rotating device while blowing by the blowing nozzle.

In addition, the drying device may be fixed to the transport station, and an object moving device may move the object relative to the drying device. The object moving device is, for example, a driving cylinder, a multi-joint robot, an orthogonal axis robot, and a gantry loader. The drying device may be a combination of the object moving device and the blowing device, or a combination of the object moving device and a decompression drying device.

According to the present disclosure, it is possible to provide a cleaning machine having a turn table and immersing an object in the cleaning liquid to perform jet cleaning.

DETAILED DESCRIPTION OF THE PREFERRED EMBODIMENTS

Figure 1:
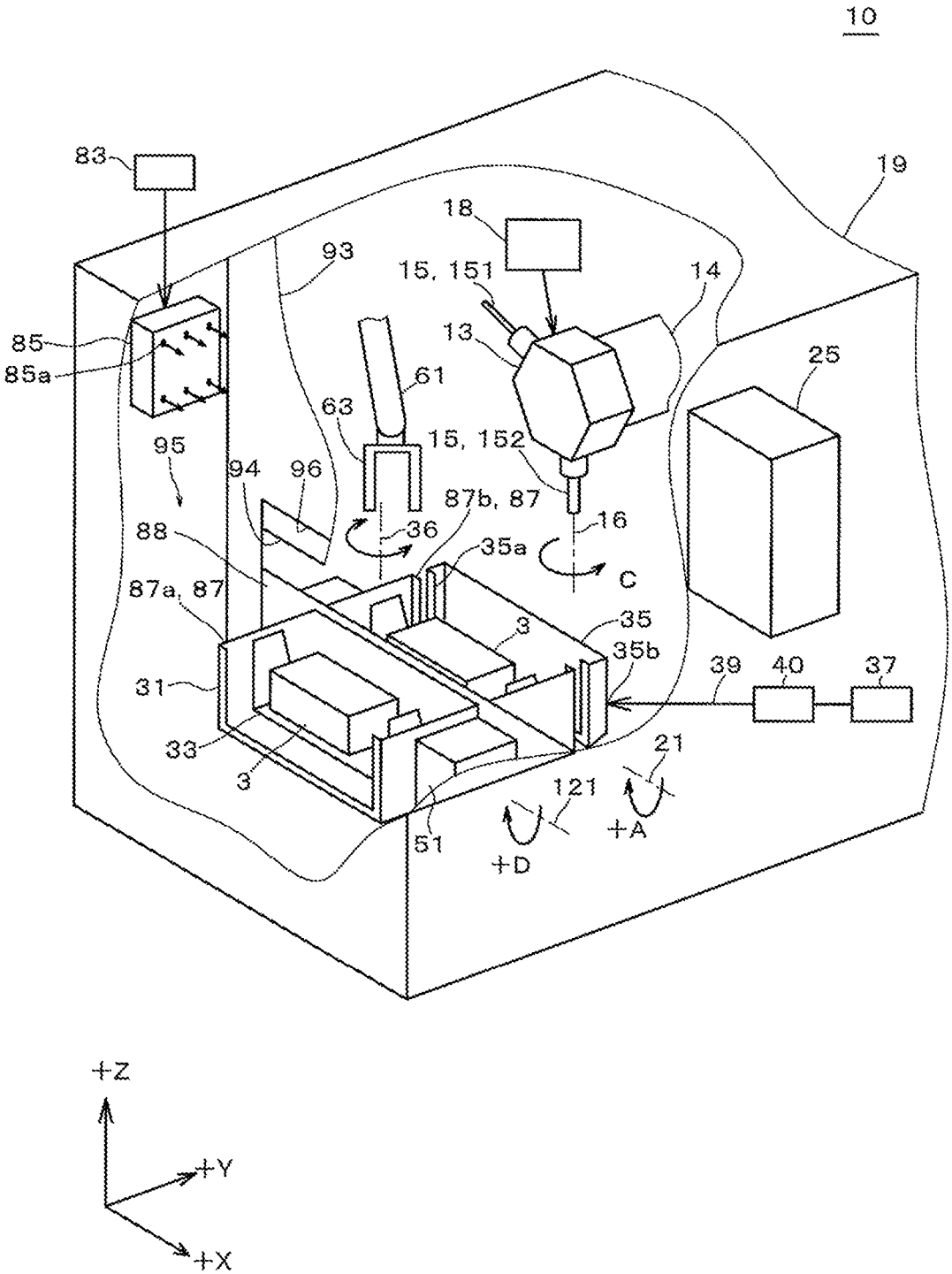
FIG. 1 is a perspective view of a cleaning machine according to an embodiment.

As shown in FIG. 1, a cleaning machine 10 includes a cleaning chamber 19, a partition wall 93, a turn table 87, a shutter 35, a cleaning table 33, a rotating device 51, a nozzle moving device (a moving device) 14, a nozzle 15, a cleaning liquid supply tank (cleaning liquid supply source) 37, and a control device 25. The cleaning machine 10 may also include an intermediate shutter 94, a blowing device 85, a moving device 61, a turret 13, a pump 18, a supply valve 40, and an air source 83.

The cleaning chamber 19 has, for example, a box shape. The cleaning chamber 19 includes a transport station 95 at the front and a cleaning station 97 at the rear. The nozzle 15 and the moving device 14 are arranged in the cleaning station 97.

The turn table 87 is arranged across the cleaning station 97 and the transport station 95. The turn table 87 includes two areas 87*a* and 87*b*, and a movable wall 88. The movable wall 88 divides the turn table 87 into two areas 87*a* and 87*b*. The turn table 87 turns 180 degrees around a rotary axis 36 as a center. The rotary axis 36 extends in a vertical direction (Z-axis direction) on a boundary between the cleaning station 97 and the transport station 95.

The areas 87*a* and 87*b* have 180-degree rotation symmetry with the rotary axis 36 as the center. By turning the turn table 87, one of the two areas 87*a* and 87*b* is positioned in the cleaning station 97, while the other is positioned in the transport station 95.

The movable wall 88 is a flat plate. The movable wall 88 is fixed to the turn table 87 on a surface that passes through the rotary axis 36 and is perpendicular to the turn table 87. When the turn table 87 is positioned, the movable wall 88 is connected with the partition wall 93. The movable wall 88 and the turn table 87 are integrated and turned around the rotary axis 36 as a center.

The partition wall 93 is a flat plate and arranged in the cleaning chamber 19. The partition wall 93 divides the cleaning chamber 19 into the cleaning station 97 and the transport station 95. The partition wall 93 passes through the rotary axis 36 and extends parallel to the XZ plane. The partition wall 93 includes a transport port 96. When the turn table 87 turns, the turn table 87, the cleaning table 33, and the object 3 pass through the transport port 96.

The intermediate shutter 94 opens and closes the transport port 96. For example, the intermediate shutter 94 is a sliding gate that slides in the vertical direction. When the intermediate shutter 94 descends, it is in contact with the movable wall 88. The intermediate shutter 94 is in contact with the movable wall 88 to close the transport port 96.

A loading port (not shown) is arranged in the transport station 95. The loading port is arranged on the front surface or the top surface of the cleaning machine 10, for example. A loading shutter (not shown) opens and closes the loading port. The loading shutter is, for example, a sliding gate.

The pump 18 includes a liquid pump, such as a piston pump, a gear pump, or a centrifugal pump. The cleaning liquid tank (not shown) supplies the cleaning liquid to the pump 18. The pump 18 supplies the cleaning liquid to the nozzle 15 via the turret 13.

The moving device 14 can freely move the turret 13 and the nozzle 15 in the lateral direction (X-axis direction), front-rear direction (Y-axis direction), and vertical direction (Z-axis direction) relative to the cleaning table 33.

A rotating device 51 causes the cleaning table 33 to rotate around the table rotating axis (rotating axis) 21 as a center along an A-axis direction.

The turret 13 is disposed on the moving device 14. The turret 13 includes a nozzle rotating axis 16 extending along the Z-axis direction. The turret 13 may also include a plurality of nozzles 15. The turret 13 is rotated to turn one nozzle 15 to the lower. The turret 13 supplies the cleaning liquid to the nozzle 15 that is turned to the lower. The moving device 14 or the turret 13 causes the nozzles 15 to rotate around the nozzle rotating axis 16 as a center along a C-axis direction.

The nozzle 15 is disposed on the turret 13. For example, the nozzle 15 includes a shaft body (not shown) extending along the rotating axis 16 and a spout (not shown) disposed at the top of the shaft body. Preferably, the nozzle 15 may rotate around the rotating axis 16 as a center or be positioned in a direction of rotating. The nozzle 15 is, for example, an submerged cleaning nozzle 151 and a horizontal nozzle 152. A high-pressure jet flow is sprayed from the spout (not shown) perpendicular to the rotating axis 16.

The blowing device 85 includes a plurality of blowing nozzles 85*a*. The air source 83 is, for example, an air compressor or a blower. The air source 83 is connected with the blowing device 85.

The moving device 61 is, for example, a multi-joint robot. The moving device 61 is disposed on the top surface of the cleaning chamber 19. The moving device 61 includes a gripping device 63 that grips the object 3 at the top. The moving device 61 grips the object 3, takes the object 3 out of the loading port (not shown), or puts the object 3 into the loading port. The moving device 61 causes the object 3 to move toward the blowing device 85 so as to dry the object 3 while changing the posture of the object 3.

Figure 2:
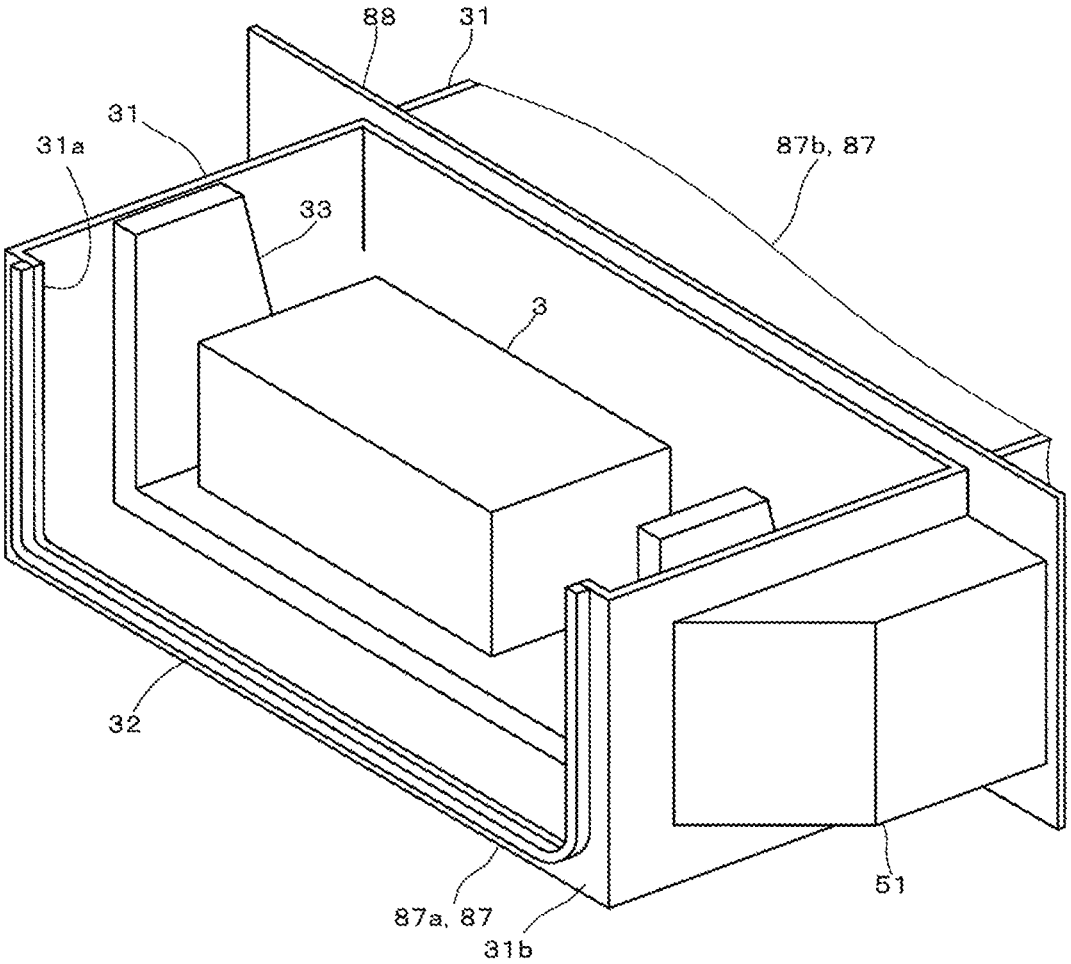
FIG. 2 is a perspective view of a cleaning tank according to an embodiment.
Figure 3:
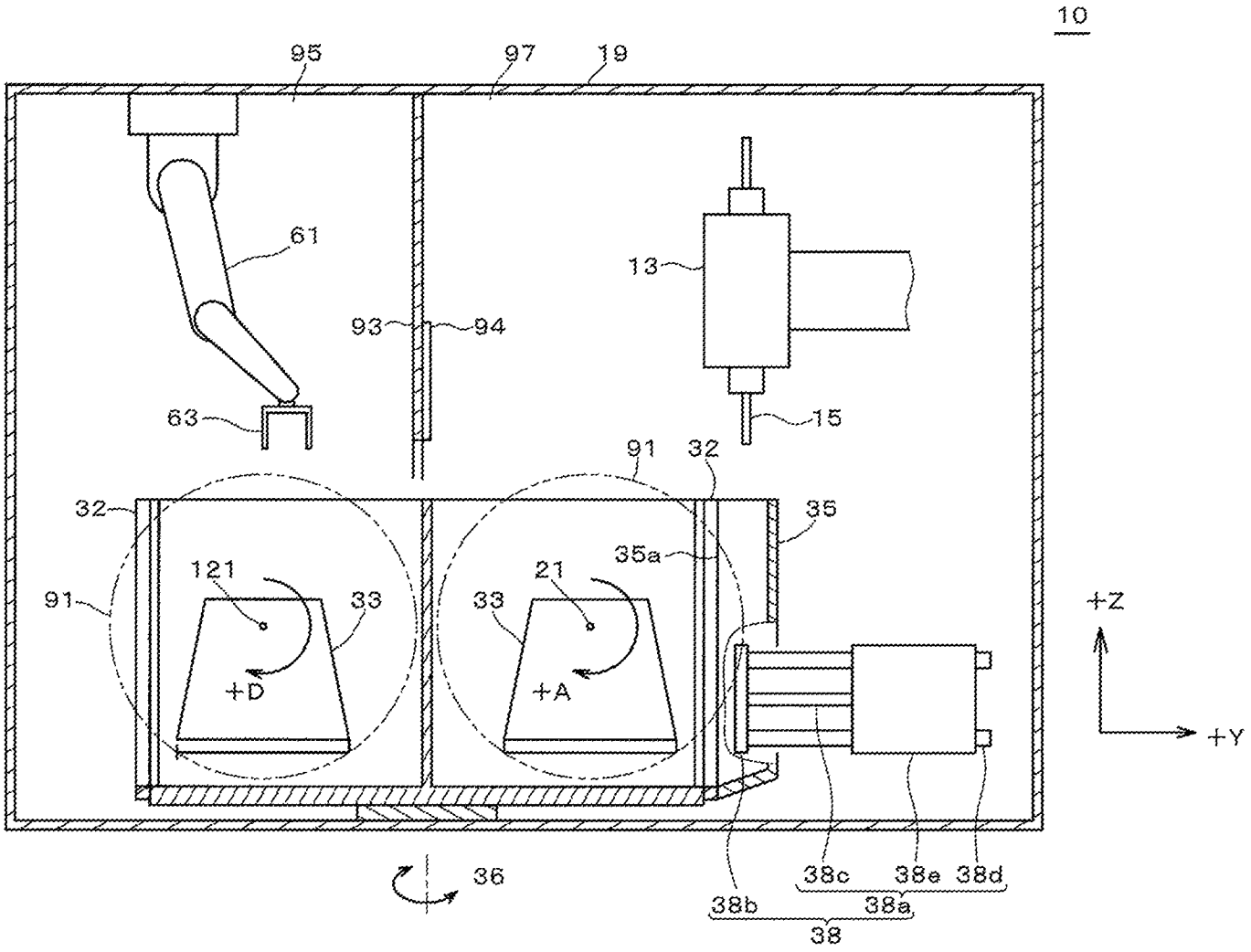
FIG. 3 is a longitudinal cross-sectional view of the cleaning machine with a shutter in a closed position according to an embodiment.

A cleaning tank 31 is arranged in each area 87*a*, 87*b*. As shown in FIG. 2, when viewed from the rotary axis 36, a front surface, a left surface, a right surface, and a bottom surface of the cleaning tank 31 are closed, and a closable opening 31*a* is disposed on a back surface (a side surface) 31*b*. The top part of the cleaning tank 31 is open. FIG. 3 is a cross-sectional view cut by the YZ plane passing through the rotary axis 36. For example, as shown in FIG. 3, the back surface 31*b* overlaps a rotating area 91 in a cross-sectional view orthogonal to the rotating axes 21, 121. The rotating area 91 refers to an area through which the object 3 and the cleaning table 33 pass when they are rotated. The bottom surface of the cleaning tank 31 may be constituted by the turn table 87. When viewed from the rotary axis 36, the front surface of the cleaning tank 31 may be constituted by the movable wall 88. The opening 31*a* has a size in lateral and vertical directions so that the cleaning table 33 does not interfere with the cleaning tank 31 when the cleaning table 33 rotates. That is, the opening 31*a* includes an area where the rotating area 91 intersects with the back surface 31*b*, and is larger than the intersecting area. The opening 31*a* can discharge the cleaning liquid.

In addition, the opening 31*a* may have a size that allows the object 3 to be loaded and unloaded and passed through when the cleaning table 33 is in a posture for loading and unloading the object 3. In this case, the loading port can be arranged on the front surface of the cleaning chamber 19. The object 3 is loaded into the cleaning table 33 of the transport station 95 through the loading port.

A seal 32 is disposed on outside of the opening 31*a* over an entire circumference of the opening 31*a*. The seal 32 seals between the shutter 35 and the cleaning tank 31. The seal 32 may also be disposed on the shutter 35.

The rotating device 51 is, for example, a circular table. When viewed from the rotary axis 36, the rotating device 51 is arranged on the left side of each cleaning tank 31. When viewed from the rotary axis 36, a support table (not shown) is arranged on the right side of each cleaning tank 31. The cleaning table 33 is rotatably supported by the rotating device 51 and the support table. The rotating device 51 rotates the cleaning table 33 around the table rotating axes (rotating axes) 21, 121 as a center. When the areas 87*a* and 87*b* are viewed from the rotary axis 36, the rotating axes 21, 121 extend in the lateral direction.

The cleaning table 33 fixes the object 3. The cleaning table 33 is arranged on each rotating device 51 and rotates around the rotating axes 21, 121 as a center.

As shown in FIG. 3, the shutter 35 is arranged at the cleaning station 97. The shutter 35 includes a contact surface 35*a* that is in contact with the seal 32. When the shutter 35 is in a closed position, it surrounds the rotating area 91 of the cleaning table 33 and the object 3 from the outside. For example, when viewed from the rotary axis 36, the shutter 35 bulges slightly backward. For example, a cleaning liquid supply port 35*b* is arranged below the shutter 35.

A shutter moving device 38 includes, for example, a driving cylinder 38*a* with a guide and a bracket 38*b*. The driving cylinder 38*a* includes a cylinder body 38*e*, a driving cylinder piston rod 38*c*, and a guide shaft 38*d*. The bracket 38*b* is fixed to the shutter 35. The cylinder body 38*e* is fixed to the cleaning chamber 19. The driving cylinder piston rod 38*c* and the guide shaft 38*d* are fixed to the bracket 38*b*. By the extension and contraction of the driving cylinder 38*a*, the guide shaft 38*d* is guided by the cylinder body 38*e*, and the shutter 35 moves. When the driving cylinder 38*a* is extended, the shutter 35 closes the opening 31*a*. When the driving cylinder 38*a* is contracted, the shutter 35 is retracted to a retracted position in the rear when the area 87*b* is viewed from the rotary axis 36.

For example, the supply tank 37 is arranged above the cleaning chamber 19. The supply tank 37 has a larger volume than the cleaning tank 31 closed by the shutter 35. The supply tank 37 is connected with the cleaning liquid supply port 35*b* via a cleaning tank supply pipe 39. The cleaning tank supply pipe 39 has a supply valve 40. When the supply valve 40 is opened, the cleaning liquid is supplied from the supply tank 37 to the cleaning tank 31.

The control device 25 controls the moving device 14, the turret 13, the turn table 87, the moving device 61, the intermediate shutter 94, the supply valve 40, the pump 18, and the blowing device 85.

Figure 4:
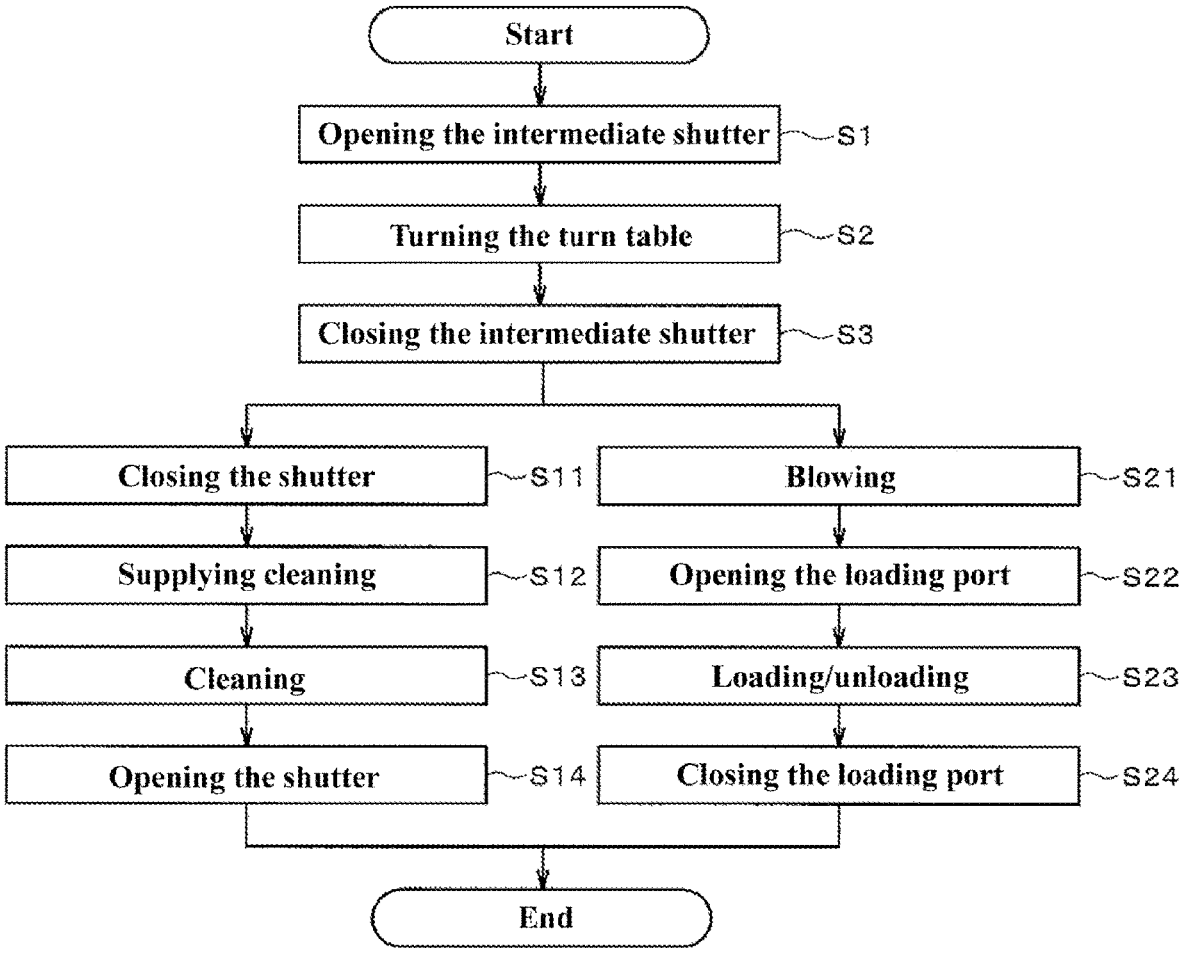
FIG. 4 shows a cleaning method according to an embodiment.

Referring to FIG. 4, a cleaning method of this embodiment will be described in the following.

First, the intermediate shutter 94 is opened (S1). Then, the turn table 87 is turned (S2). At this time, the object 3 before cleaning at the transport station 95 is transported to the cleaning station 97, and the cleaned object 3 at the cleaning station 97 is transported to the transport station 95. Then, the intermediate shutter 94 is closed (S3). At this time, the cleaning station 97 is separated from the transport station 95 by the partition wall 93, the intermediate shutter 94, and the movable wall 88.

The cleaning operations in the cleaning station 97 will be described in the following.

The shutter moving device 38 moves the shutter 35 to the closed position to close the opening 31*a* (S11). The supply valve 40 is opened, and the cleaning liquid is supplied to the cleaning tank 31 (S12). As a result, the cleaning tank 31 is filled with the cleaning liquid, and the object 3 is immersed in the cleaning liquid.

The pump 18 supplies the cleaning liquid to the nozzle 15, and the nozzle 15 sprays the cleaning liquid. The rotating device 51 moves the object 3, the moving device 14 moves the nozzle 15, and the nozzle 15 causes the jet flow to collide with the object 3. The nozzle 15 moves along a movement path, thereby cleaning the object 3 (S13).

The shutter moving device 38 moves the shutter 35 to the retracted position. The cleaning liquid stored in the cleaning tank 31 is discharged from the closable opening 31*a* (S14).

In this way, the cleaning of the object 3 ends.

The operations of transport and drying in the transport station 95 will be described in the following.

The moving device 61 grips the cleaned object 3 and moves it toward the blowing device 85. The blowing device 85 blows air to the object 3 for blowing (S21).

The loading shutter (not shown) opens the loading port (not shown) (S22).

The moving device 61 takes out the dried object 3 via the loading port (not shown). Then, the moving device 61 puts in the object 3 to be cleaned via the loading port (not shown) (S23).

The loading shutter (not shown) closes the loading port (not shown) (S22).

When the cleaning machine 10 is started, the cleaned object 3 is transported to the transport station 95, and a newly loaded object 3 is transported to the cleaning station 97.

According to this embodiment, when the areas 87*a* and 87*b* are viewed from the rotary axis 36, the opening 31*a* is arranged on the back surface, and the shutter 35 can move in the front-rear direction. Therefore, a depth of the cleaning tank 31 can be reduced. Therefore, the maximum rotation radius of the turn table 87 when turning becomes smaller, and the provision area of the cleaning machine 10 can be reduced.

What is claimed is:

1. A cleaning machine for cleaning an object, comprising:

a cleaning chamber having a cleaning station and a transport station;

a turn table having a plurality of areas arranged around a rotary axis, each of the plurality of areas having a cleaning tank including a closable opening, a rotating device arranged at the cleaning tank, and a cleaning table on which the object is placed, wherein the cleaning table is arranged on the rotating device and rotatably arranged in the cleaning tank, wherein one area of the plurality of areas is positioned in the cleaning station and another area of the plurality of areas is positioned in the transport station such that the cleaning station includes the cleaning tank of said one area of the plurality of areas positioned in the cleaning station which serves as a cleaning station tank;

a nozzle moving device arranged in the cleaning station;

a cleaning nozzle arranged on the nozzle moving device;

a shutter arranged in the cleaning station to face a back surface of the cleaning station tank positioned in the cleaning station when viewing the cleaning station tank along the rotary axis and for closing the closable opening of the cleaning station tank, wherein the closable opening of the cleaning station tank is located on the back surface of the cleaning station tank; and a shutter moving device configured to move the shutter in an extended direction toward the closable opening of the cleaning station tank to close the closable opening of the cleaning station tank when the closable opening of the cleaning station tank needs to be closed, and to move the shutter in a retracted direction outward the closable opening of the cleaning station tank to open the closable opening of the cleaning station tank when the closable opening of the cleaning station tank needs to be opened, wherein the extended direction and the retracted direction are perpendicular to the rotary axis and the back surface of the cleaning station tank on which the closable opening of the cleaning station tank is located, wherein the shutter moving device comprises a driving cylinder, and a bracket fixed to the shutter, wherein the driving cylinder includes a cylinder body fixed to the cleaning station, and a driving cylinder piston rod and a guide shaft both extending from the cylinder body and fixed to the bracket, wherein by extension or contraction of the driving cylinder, the driving cylinder piston rod is extended or contracted and the guide shaft is guided by the cylinder body, thereby moving the shutter, such that when the driving cylinder is extended, the shutter closes the closable opening of the cleaning station tank, and when the driving cylinder is contracted, the shutter is retracted to a retracted position.

2. The cleaning machine as in claim 1, further comprising a seal which is arranged on either of the closable opening of the cleaning station tank and the shutter, and is arranged over an entire circumference of a contact surface between the cleaning station tank and the shutter.

3. The cleaning machine as in claim 1, wherein the rotating device is arranged on either of a left side and a right side of the cleaning tank when viewing along the rotary axis, and wherein the cleaning table is supported at both ends with a table rotating axis extending along a lateral direction as the center.

4. The cleaning machine as in claim 2, wherein the rotating device is arranged on either of a left side and a right side of the cleaning tank when viewing along the rotary axis, and wherein the cleaning table is supported at both ends with a table rotating axis extending along a lateral direction as the center.

5. The cleaning machine as in claim 3, wherein the closable opening has a size in lateral and vertical directions so that the cleaning table does not interfere with the cleaning tank when the cleaning table is rotated.

6. The cleaning machine as in claim 4, wherein the closable opening has a size in lateral and vertical directions so that the cleaning table does not interfere with the cleaning tank when the cleaning table is rotated.

7. The cleaning machine as in claim 1, wherein the shutter has a cleaning liquid supply port.

8. The cleaning machine as in claim 2, wherein the shutter has a cleaning liquid supply port.

9. A cleaning machine for cleaning an object, comprising:

a cleaning chamber having a cleaning station and a transport station;

a turn table having a plurality of areas arranged around a rotary axis, each of the plurality of areas having a cleaning tank including a closable opening, a rotating device arranged at the cleaning tank, and a cleaning table on which the object is placed, wherein the cleaning table is arranged on the rotating device and rotatably arranged in the cleaning tank, wherein one area of the plurality of areas is positioned in the cleaning station and another area of the plurality of areas is positioned in the transport station such that the cleaning station includes the cleaning tank of said one area of the plurality of areas positioned in the cleaning station which serves as a cleaning station tank;

a nozzle moving device arranged in the cleaning station;

a cleaning nozzle arranged on the nozzle moving device;

a shutter arranged in the cleaning station to face a back surface of the cleaning station tank positioned in the cleaning station when viewing the cleaning station tank along the rotary axis and for closing the closable opening of the cleaning station tank, wherein the closable opening of the cleaning station tank is located on the back surface of the cleaning station tank; and a shutter moving device configured to move the shutter in an extended direction toward the closable opening of the cleaning station tank to close the closable opening of the cleaning station tank when the closable opening of the cleaning station tank needs to be closed, and to move the shutter in a retracted direction outward the closable opening of the cleaning station tank to open the closable opening of the cleaning station tank when the closable opening of the cleaning station tank needs to be opened, such that when the shutter is retracted to a retracted position, the turn table rotates without interfering with the shutter, wherein the extended direction and the retracted direction are perpendicular to the rotary axis and the back surface of the cleaning station tank on which the closable opening of the cleaning station tank is located, wherein the shutter moving device comprises a driving cylinder, and a bracket fixed to the shutter, wherein the driving cylinder includes a cylinder body fixed to the cleaning station, and a driving cylinder piston rod and a guide shaft both extending from the cylinder body and fixed to the bracket, wherein by extension or contraction of the driving cylinder, the driving cylinder piston rod is extended or contracted and the guide shaft is guided by the cylinder body, thereby moving the shutter, such that when the driving cylinder is extended, the shutter closes the closable opening of the cleaning station tank, and when the driving cylinder is contracted, the shutter is retracted to a retracted position.

10. The cleaning machine as in claim 9, wherein the rotating device is arranged on either of a left side and a right side of the cleaning tank when viewing along the rotary axis, and wherein the cleaning table is supported at both ends with a table rotating axis extending along a lateral direction as the center.

* * * * *